US008984691B2

(12) United States Patent
Bae et al.

(10) Patent No.: US 8,984,691 B2
(45) Date of Patent: Mar. 24, 2015

(54) LAUNDRY MACHINE

(75) Inventors: Sang Hun Bae, Changwon-si (KR); Dong Geun Lee, Changwon-si (KR); Yeon Sik Choi, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1767 days.

(21) Appl. No.: 12/109,050

(22) Filed: Apr. 24, 2008

(65) Prior Publication Data

US 2008/0271263 A1 Nov. 6, 2008

(30) Foreign Application Priority Data

Apr. 25, 2007 (KR) ..... 10-2007-0040318

(51) Int. Cl.
*D06F 35/00* (2006.01)
*D06F 58/20* (2006.01)
*D06F 58/28* (2006.01)

(52) U.S. Cl.
CPC ..... *D06F 58/203* (2013.01); *D06F 58/28* (2013.01); *D06F 2058/2858* (2013.01)
USPC ..... 8/158

(58) Field of Classification Search
CPC ..... D06F 39/008; D06F 2058/2858
USPC ..... 68/5 R, 5 C, 19.2, 20; 8/149.3, 158, 159
See application file for complete search history.

(56) References Cited

U.S. PATENT DOCUMENTS 5,337,703 A * 8/1994 Schlesch et al. ..... 122/379
2006/0277690 A1 * 12/2006 Pyo et al. ..... 8/149.2

FOREIGN PATENT DOCUMENTS

JP 02116399 A * 5/1990
KR 10-2003-0080343 A 10/2003
KR 10-0698132 B1 3/2007
KR 10-2008-0007845 A 1/2008
KR 10-2008-0012006 A 2/2008

* cited by examiner

*Primary Examiner* — David Cormier
(74) *Attorney, Agent, or Firm* — McKenna Long & Aldridge LLP

(57) ABSTRACT

A laundry machine and a control method thereof are disclosed. The disclosed laundry machine includes a drum rotatably installed in a cabinet, a substance supply device for supplying moisture to the drum, a water supply device separably mounted to the cabinet, to supply water to the substance supply device, a sensor for sensing whether or not water is supplied to the water supply device, and a controller for controlling the substance supply device in accordance with a sensing signal from the sensor.

13 Claims, 7 Drawing Sheets

LAUNDRY MACHINE

This application claims the benefit of Korean Patent Application No. 10-2007-0040318, filed on Apr. 25, 2007, which is hereby incorporated by reference as if fully set forth herein.

BACKGROUND OF THE INVENTION

1. Field of the Invention

The present invention relates to a laundry machine and a control method thereof, and more particularly to a laundry machine and a control method thereof, which are capable of removing creases from laundry during a drying operation for the laundry, and sensing whether or not water is supplied to a steam generator.

2. Discussion of the Related Art

Typically, a laundry dryer, which is a kind of a laundry machine, is a home appliance used to dry laundry, mainly clothes, completely washed, using hot air. Generally, such a laundry dryer includes a drum for accommodating laundry to be dried therein, and a drive source for driving the drum, a heater for heating air introduced into the drum, and a blower unit for sucking air into the drum or outwardly discharging air from the drum.

Laundry dryers may be classified into an electric type and a gas type in accordance with the type of the system for heating air, namely, the type of the heater. The electric type laundry dryer heats air, using heat generated from an electrical resistance. On the other hand, the gas type laundry dryer heats air, using heat generated in accordance with the combustion of gas.

Laundry dryers may also be classified into a condensation type and an exhaustion type. In the condensation type laundry dryer, air, which has become humid after being heat-exchanged with laundry to be dried, is circulated without being outwardly discharged. The air is heat-exchanged with ambient air through a separate condenser. In accordance with this heat exchange, condensed water is generated, and is then outwardly discharged. In the exhaustion type laundry dryer, air, which has become humid after being heat-exchanged with laundry to be dried, is directly discharged to the outside of the laundry dryer.

Laundry dryers may also be classified into a top loading type and a front loading type in accordance with the laundry loading type. In the top loading type laundry dryer, laundry to be dried is loaded into the laundry dryer through the top of the laundry dryer. On the other hand, in the front loading type laundry dryer, laundry to be dried is loaded into the laundry dryer through the front side of the laundry dryer.

Meanwhile, conventional laundry dryers as mentioned above have the following problems.

Typically, in a laundry dryer, laundry spin-dried after being completely washed is loaded so that it can be dried. In this case, the laundry, which has been washed using water, has creases due to the principle of the water washing. In the drying procedure carried out in the laundry dryer, however, the creases cannot be completely removed. In order to remove the creases still present on objects, such as laundry, completely dried in conventional laundry dryers, it is necessary to perform ironing.

Where clothes other than laundry completely washed are stored or used in a typical manner, creases, rumples, or holds (hereinafter, generally referred to as "creases") may be formed at the clothes. To this end, it has been required to develop an apparatus capable of conveniently removing creases generated during the storage or use of clothes.

SUMMARY OF THE INVENTION

Accordingly, the present invention is directed to a laundry machine that substantially obviates one or more problems due to limitations and disadvantages of the related art.

An object of the present invention is to provide a laundry machine and a control method thereof, which are capable of avoiding the formation of creases on clothes, etc. and/or removing creases formed on clothes, etc.

Another object of the present invention is to provide a laundry machine capable of sensing whether or not a water supply source to supply water to the laundry machine, namely, a cartridge, is in a correctly-mounted state, and selectively operating the laundry machine in accordance with the sensed result.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine comprises: a drum rotatably installed in a cabinet; a substance supply device for supplying moisture to the drum; a water supply device separably mounted to the cabinet, to supply water to the substance supply device; a sensor for sensing whether or not water is supplied to the water supply device; and a controller for controlling the substance supply device in accordance with a sensing signal from the sensor.

In another aspect of the present invention, a method for controlling a laundry machine comprises: receiving a command input to operate the laundry machine; sensing whether or not water is supplied to a steam generator of the laundry machine; and executing a drying process of the laundry machine.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
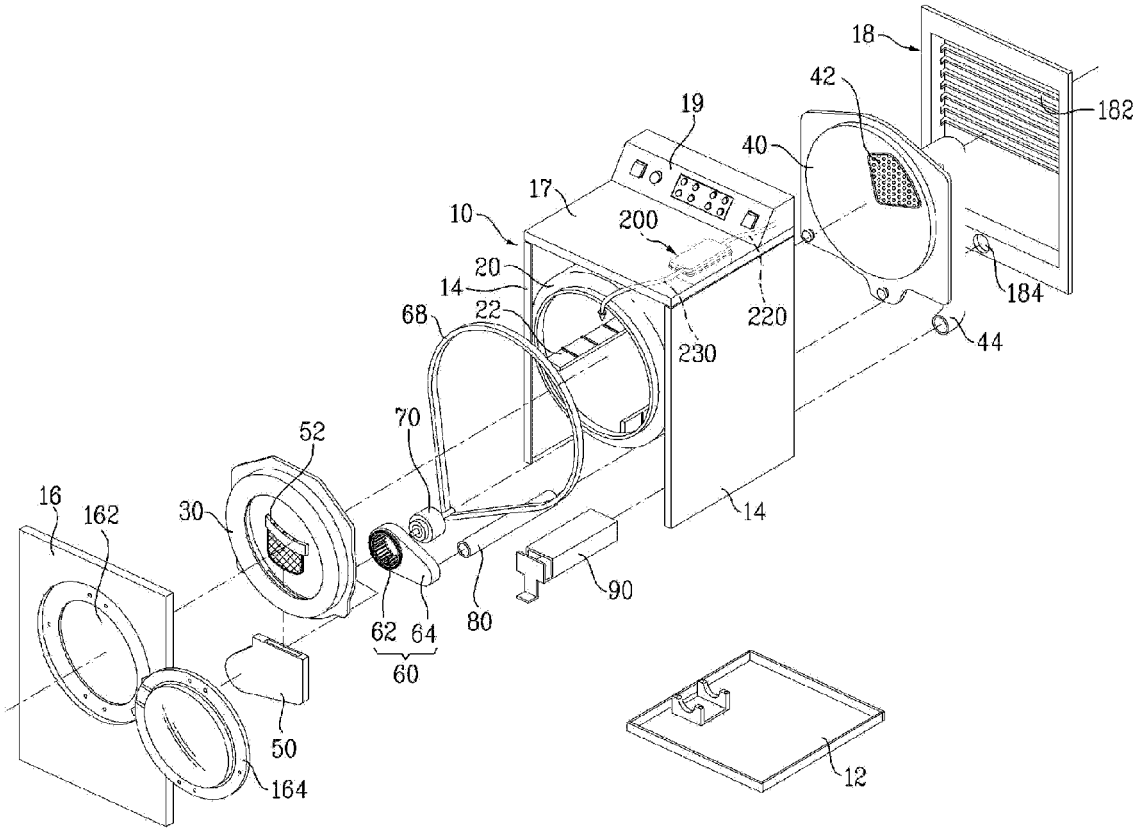
FIG. 1 is an exploded perspective view illustrating a laundry machine according to a preferred embodiment of the present invention.

FIG. 1 is an exploded perspective view illustrating a laundry machine according to a preferred embodiment of the present invention. Hereinafter, the laundry machine according to the illustrated embodiment of the present invention will be described with reference to FIG. 1.

A cabinet 10 forms an outer structure of the laundry machine, namely, a laundry dryer, according to the present invention. Various constituent elements of the laundry machine, namely, the laundry dryer are arranged in the interior of the cabinet 10.

That is, a rotatable drum 20, and a motor 70 and a belt 68, which are adapted to drive the drum 20, may be installed in the cabinet 10. An air heater 90 may be arranged in the cabinet 10 at a desired position, to heat air, and thus to generate hot air. A hot air supply duct 44 may also be arranged in the cabinet 10, to supply the hot air generated by the air heater 90 to the drum 20. In the cabinet 10, an exhaust duct 80 for exhausting humid air heat-exchanged with objects to be dried in the drum 20, and a blower unit 60 for sucking the humid air may also be arranged. Meanwhile, a substance supply device may be arranged in the cabinet 10 at a desired position, to supply water based substance to the drum 20.

Although an indirect drive type, in which the motor 70 and belt 68 are used to rotate the drum 20, is illustrated and described in this embodiment, the present invention is not limited thereto. That is, a direct drive type, in which a motor is directly connected to a rear wall of the drum 20, to directly rotate the drum 20, may be applied to the present invention.

Hereinafter, the above-described constituent elements will be described in more detail.

The cabinet 10, which forms the outer structure of the laundry machine, namely, the laundry dryer, may include a base 12 forming a bottom wall, a pair of side covers 14 extending vertically from the base 12, a front cover 16 mounted to the front ends of the side covers 14, a rear cover 18 mounted to the rear ends of the side covers 14, and a top cover 17 disposed on the upper ends of the side covers 14. A control panel 19, which includes various operating switches or the like, may be arranged on the top cover 17 or front cover 16. A door 164 may be mounted to the front cover 16. A louver 182 is provided at the rear cover 18, to introduce ambient air into the cabinet 10. An exhaust hole 184 is also provided at the rear cover 18, as a passage for finally discharging air from the drum 20 to the outside of the drum 20.

The interior of the drum 20 functions as a drying chamber, in which a drying operation is carried out. It is preferred that a lift 22 be installed in the drum 20, to drop laundry after raising the laundry such that the laundry is turned over, and thus to achieve an enhancement in drying efficiency.

Meanwhile, a front supporter 30 and a rear supporter 40 may be installed between the drum 20 and the cabinet 10, namely, between the drum 20 and the front cover 16 and between the drum 20 and the rear cover 18, respectively. The drum 20 is rotatably installed between the front supporter 30 and the rear supporter 40. Sealing members (not shown) are fitted between the front supporter 30 and the drum 20 and between the rear supporter 40 and the drum 20, respectively, to prevent water leakage. That is, the front supporter 30 and rear supporter 40 close the front and rear ends of the drum 20, to define the drying chamber in the drum 20. The front supporter 30 and rear supporter 40 also function to support the front and rear ends of the drum 20.

An opening is formed through the front supporter 30, to communicate the drum 20 with the outside of the laundry machine. The opening is selectively opened or closed by the door 164. A lint duct 50, which is a passage for outwardly discharging air from the drum 20, is connected to the front supporter 30. A lint filter 52 is installed in the lint duct 50.

One side of the blower unit 60 is connected to the lint duct 50. The other side of the blower unit 60 is connected to the exhaust duct 80. The exhaust duct 80 communicates with an exhaust hole 184 provided at the rear cover 18.

Accordingly, when the blower unit 60 operates, air present in the drum 20 is exhausted from the drum 20 via the lint duct 50, exhaust duct 80, and exhaust hole 184. During this operation, foreign matter such as lint is filtered out by the lint filter 52. Typically, the blower unit 60 includes a blower 62, and a blower housing 64. Typically, the blower 62 is connected to the motor 70, which drives the drum 20.

An opening 42, which is constituted by a plurality of through holes, is formed through the rear supporter 40. A hot air supply duct 44 is connected to the opening 42. The hot air supply duct 44 communicates with the drum 20, to function as a passage for supplying hot air to the drum 20. To this end, the air heater 90 is installed at a certain position in the hot air supply duct 44.

A substance supply device is installed at a desired position in the cabinet 10, to supply water based substance, e.g., moisture or steam to the drum 20. Thus, the substance supply device functions to supply water based substance to the drum 20.

For example, the substance supply device includes a pressure apply device, which applies a certain pressure to water supplied to the drum 20, and thus to supply moisture to the drum 20 through a nozzle. In this case, the pressure apply device may comprise a separate pump. Alternatively, a water supply line included in the laundry machine may be directly connected to an external city water tap, to apply water supplied by the water supply line to a certain pressure in accordance with the water pressure from the city water tap. When water is supplied under pressure, it can be sprayed into the interior of the drum 20 through a nozzle or the like, in the form of mist.

Meanwhile, in the illustrated embodiment of the present invention, a steam generator 200, which generates steam, and supplies the generated steam into the interior of the drum 20, functions as the substance supply device. Hereinafter, the steam generator will be described with reference to the accompanying drawings.

Figure 2:
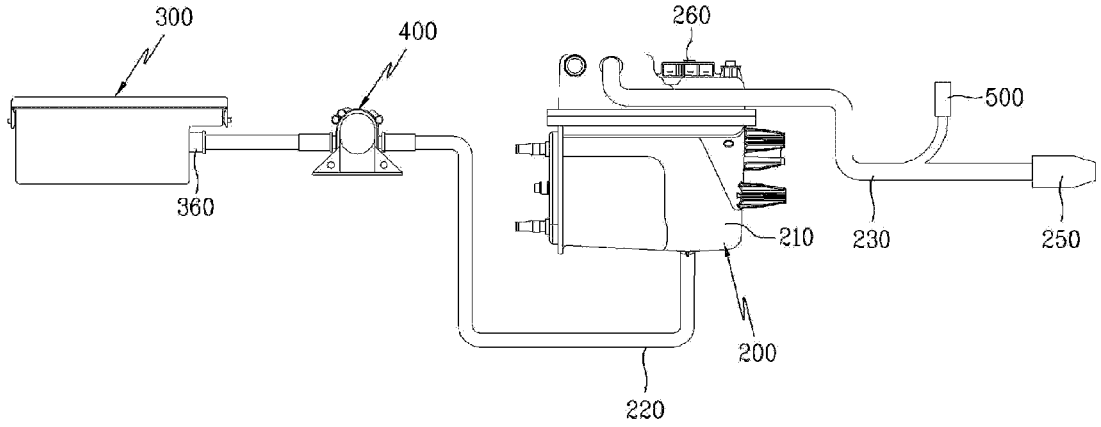
FIG. 2 is a sectional view illustrating a cartridge to supply water and a steam generator, which are included in the laundry machine of FIG. 1 in accordance with an exemplary embodiment of the present invention.

FIG. 2 is a sectional view illustrating the steam generator included in the laundry machine in accordance with the illustrated embodiment of the present invention. Hereinafter, the steam generator will be described in detail with reference to FIG. 2.

The steam generator 200 includes a water tank 210 for containing water therein, a heater (not shown) mounted in the water tank 210, a water level sensor 260 for measuring the water level of the steam generator 200, and a temperature sensor (not shown) for measuring the temperature of the steam generator 200. Although not shown, the water level sensor 260 typically includes a common electrode, a low-water-level electrode, and a high-water-level electrode. A low water level or a high water level is sensed in accordance with whether the common electrode is electrically connected with the low-water-level electrode or with the high-water-level electrode.

A water supply hose 220 is connected to one side of the steam generator 200, to supply water to the steam generator 200. A steam hose 230 is connected to the other side of the steam generator 200, to discharge steam from the steam generator 200. Preferably, a nozzle 250 having a certain shape is arranged at an end of the steam hose 230 opposite to the steam generator 200, to spray steam. Typically, the water supply hose 220 is connected to an external water supply source such as a cartridge 300, at an end of the water supply hose 220 opposite to the steam generator 200. The end of the steam hose 230 opposite to the steam generator 200 or the nozzle 250, namely, a steam outlet, is disposed at a desired position in the drum 20, to spray steam into the interior of the drum 20.

In accordance with the illustrated embodiment, the water supply source comprises the cartridge 300, which is separably installed, as described above. Of course, the water supply source may also comprise an external city water tap. Where the water supply source comprises a city water tap, however, there is a difficulty in connecting the steam generator 200 to the city water tap. This is because no water is used in a typical laundry dryer. That is, when the city water tap is used as a water supply source, it is necessary to additionally install various devices associated with the city water tap. Therefore, there is a convenience in the case in which a detachable water supply source 300 is used in such a manner that water is supplied to the water supply source 300 in a separated state of the water supply source 300, and the water-filled water supply source 300 is then connected to the water supply line of the steam generator 200, namely, the water supply hose 220, as in the present embodiment.

Preferably, a pump 400 may be arranged between the water supply source 300 and the steam generator 200. More preferably, the pump 400 is rotatable in normal and reverse directions, not only to supply water to the steam generator 200, but also to recover residual water from the steam generator 200, if necessary. The reason why residual water is recovered from the steam generator 200 is that, when the steam generator 200 is not used for a prolonged period of time, the residual water may cause damage to the heater of the steam generator 200, or may be used in a decomposed state. Preferably, a safety valve 500 is also arranged in a steam line, namely, the steam hose 230, which discharges steam from the steam generator 200.

Hereinafter, a configuration, in which the cartridge functioning as the water supply source in the laundry machine of the present invention is installed in the cabinet, will be described with reference to the accompanying drawings.

Figure 3:
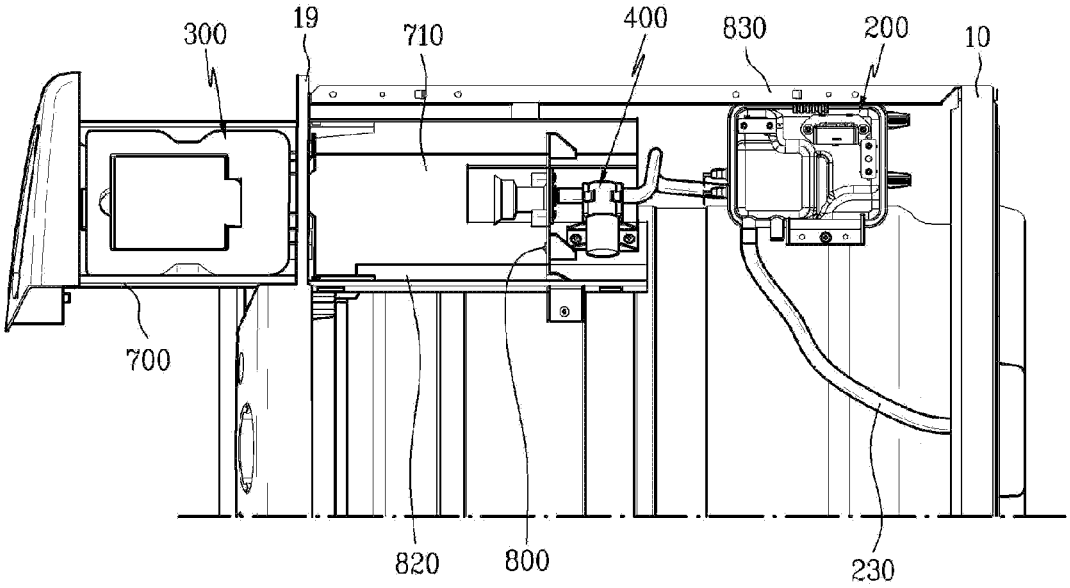
FIG. 3 is a plan view schematically illustrating a water supply device included in a laundry machine according to another embodiment of the present invention.

Referring to FIG. 3, the laundry machine according to the illustrated embodiment of the present invention may include a drawer 700, which is detachably installed in the cabinet 10. The cartridge 300 may be selectively mounted in the cartridge 300. That is, the cartridge 300 is selectively mounted in the drawer 700 so that it functions as a water supply device to supply water to the steam generator 200.

Where the cartridge 300 is mounted as described above, it is preferred that the drawer 700 be detachably installed in the cabinet 10, and the cartridge 300 be mounted in the drawer 700, as compared to a configuration in which the cartridge 300 is detachably installed in the cabinet 10 in a direct manner.

The drawer 700 may be detachably installed at one side of the cabinet 10. Preferably, the drawer 700 is detachably installed at the front side of the cabinet 10. In detail, the drawer 700 is installed at the front side of the cabinet 10 such that it can be slidably inserted into and ejected from the interior of the cabinet 10. The sliding movement of the drawer 700 is guided by a drawer guide 710, which is installed at one side of the cabinet 10. The drawer guide 710 will be described in detail later.

The cartridge 300 may be detachably mounted in the drawer 700. The cartridge 300 contains water to be supplied to the steam generator 200. In the illustrated case, the cartridge 300 is detachably mounted in the drawer 700. When it is desired to supply water to the laundry machine, the user ejects the drawer 700, and then separates the cartridge 300 from the drawer 700. After filling water in the separated cartridge 300, the operator mounts the water-filled cartridge 300 in the drawer 700, and then inserts the drawer 700 into the interior of the cabinet 10.

Where the drawer 700 is movable as described above, it is preferred that a drawer guide 710 be provided at the cabinet 10, to guide the movement of the drawer 700. The drawer guide 710 is formed at an inner surface of the cabinet 10 such that it extends from an opening formed at the front side of the cabinet 10 into the interior of the cabinet 10. Preferably, the drawer guide 710 has a shape corresponding to an outer structure of the drawer 700. In detail, it is preferred that a supporter 820 be installed in the rear of the control panel 19 such that it extends to be substantially parallel to a top frame 830, and the drawer guide 710 be arranged between the supporter 820 and the top frame 830. Although not shown, it is also preferred that a top guide be provided to cover a top portion of the drawer guide 710.

Accordingly, it is possible to selectively connect the cartridge 300 to the pump 400 by mounting the cartridge 300 in the drawer 700, and then inserting the drawer 700 along the drawer guide 710.

In FIG. 3, reference numeral "800" designates a sensor 800 for sensing whether or not the water supply device as described above, in detail, the drawer 700, is in a mounted state. The sensor 800 will be described in detail later.

Figure 4:
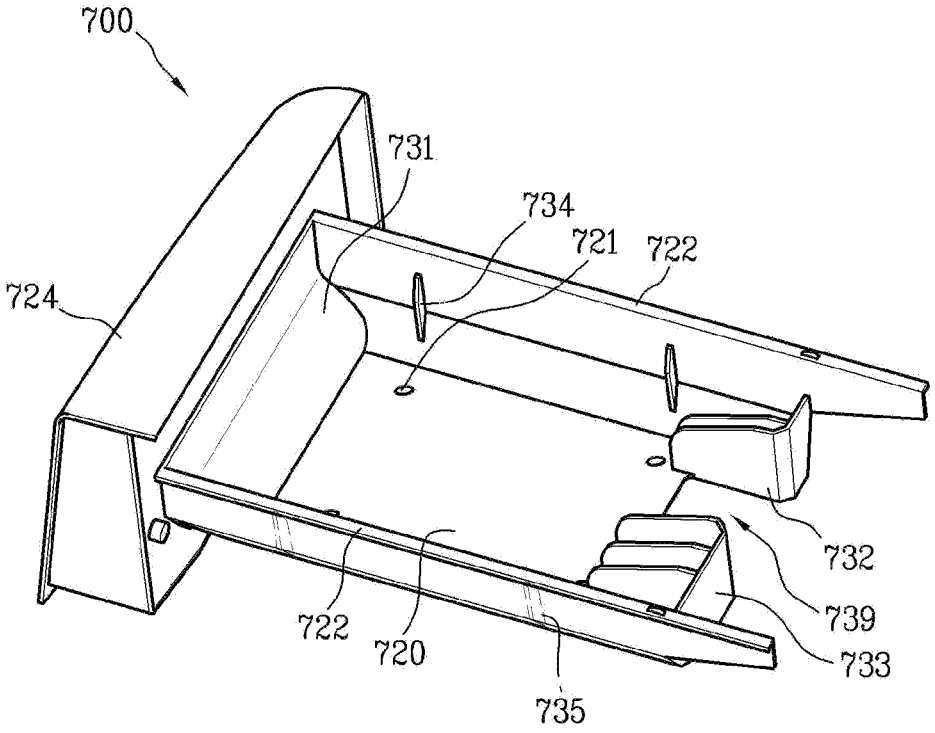
FIG. 4 is a perspective view illustrating a drawer shown in FIG. 3.

Hereinafter, the drawer 700, in which the cartridge 300 is mounted, will be described with reference to the accompanying drawings. FIG. 4 is a perspective view illustrating a structure of the drawer 700 according to a preferred embodiment of the present invention.

Referring to FIG. 4, the drawer 700 may substantially have an upwardly-opened box shape corresponding to the shape of the cartridge 300 (FIG. 3). In detail, the drawer 700 may include a base 720, and side walls 722 extending vertically from the base 720. The drawer 700 may also include a cover 724 arranged at a front side of the drawer 700, to enable the user to easily insert or eject the drawer 700 (hereinafter, an end toward an ejection direction of the drawer 700 is referred as a "front end", and an end opposite to the front end is referred to as a "rear end").

Meanwhile, a guide member and a positioning member may be provided in the drawer 700. The guide member functions to guide the cartridge 300 to a desired position in the drawer 700 when the cartridge 300 is mounted in the drawer 700. The positioning member functions to position the cartridge 300 at a correct position.

The guide member may comprise a protrusion 731 inwardly protruded from a front end of the drawer 700 in the interior of the drawer 700, at least one first guide 732 arranged at a rear end of the drawer 700, and second guides 734 and 735 respectively inwardly protruded from opposite side walls of the drawer 700 in the interior of the drawer 700.

In this case, the guide member may be formed such that the distance between the protrusion 731 and the first guide 732 corresponds to the length of the cartridge 300, and the distance between the second guides 734 and 735 corresponds to the width of the cartridge 300. Accordingly, when the cartridge 300 is mounted in the drawer 700, it is positioned in a space defined by the protrusion 731, first guide 732, and second guides 734 and 735.

Although not shown, the positioning member may comprise a positioning protrusion (not shown) formed at an outer bottom surface of the cartridge 300, and a positioning groove (not shown) formed at an inner bottom surface of the drawer 700. Accordingly, when the cartridge 300 is positioned in the space defined by the protrusion 731, first guide 732, and second guides 734 and 735, the positioning protrusion of the cartridge 300 is inserted into the positioning groove 721 of the drawer 700, so that the cartridge 300 can be positioned at a correct position.

Meanwhile, it is preferred that an opening 739 be formed through the rear end of the drawer 700, to provide a space, through which a connector 360 (FIG. 2) provided at the cartridge 300 can be connected to the cartridge 300, when the cartridge 300 is to be connected to the pump 400.

After mounting the cartridge 300 in the interior of the drawer 700, as described above, the user moves the drawer 700 into the cabinet 10 along the drawer guide 710, to connect the cartridge 300 to the pump 400. Hereinafter, the structure of the drawer guide 710 functioning to guide the movement of the drawer 700 will be described.

Figure 5:
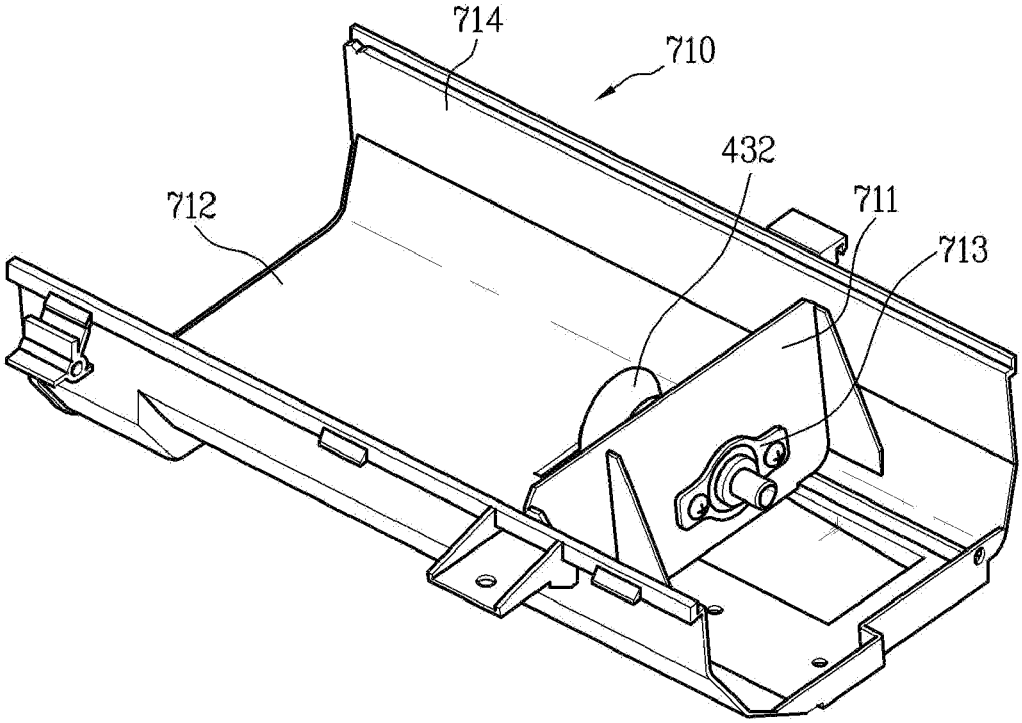
FIG. 5 is a perspective view illustrating a drawer guide shown in FIG. 3.
Figure 6:
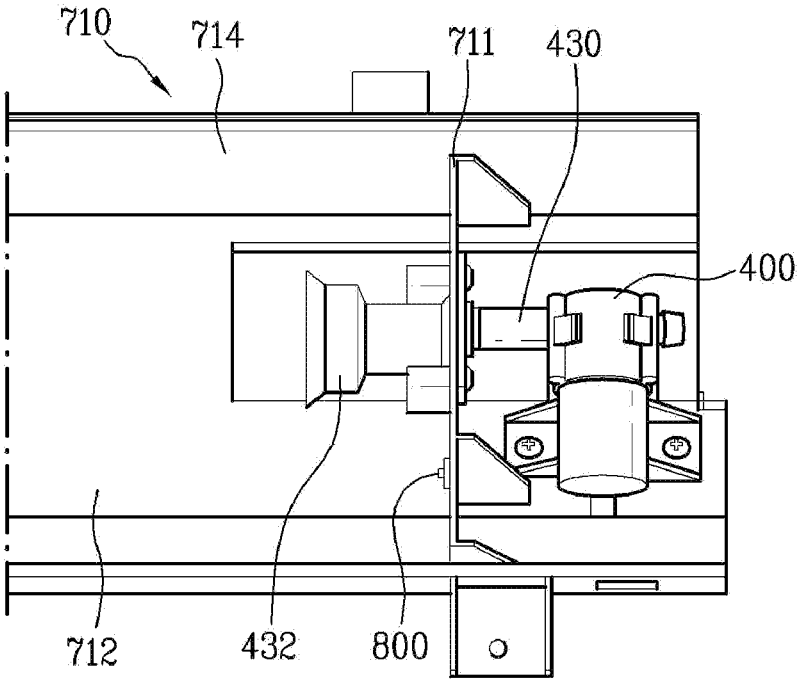
FIG. 6 is a perspective view illustrating a configuration of FIG. 5 correspond to a switch.

FIG. 5 is a perspective view illustrating an exemplary embodiment of the drawer guide 710 in the laundry machine according to the present invention. FIG. 6 is a perspective view illustrating a part of the drawer guide 710 shown in FIG. 5.

Referring to FIGS. 5 and 6, the drawer guide 710 may include a base 712, and a pair of side walls 714 extending vertically from opposite side ends of the base 712, respectively. The drawer guide 710 is arranged at the front side of the laundry machine, in order to guide the drawer 700 to be inserted into or ejected from a space defined by the base 712 and side walls 714.

Meanwhile, the pump 400 may be arranged at a rear side of the drawer guide 710 so that the pump 400 can be connected with the cartridge 300 (FIG. 3). Accordingly, when the user inserts the drawer 700 into the laundry machine, the connector 360 of the cartridge 300 is connected to the pump 400. Accordingly, water from the cartridge 300 can be supplied to the steam generator 200 via the pump 400.

A shield plate 711 may be provided at the drawer guide 710, to prevent the interior of the drawer 700, in particular, a rear portion of the drawer 700, from being open to the view in an ejected state of the drawer 700.

The shield plate 711 may be mounted to the drawer guide 710 adjacent to the pump 400. That is, the shield plate 711 may be arranged cross the interior of the drawer guide 710 when viewing from the front side of the drawer guide 710. In accordance with this arrangement, the user cannot view the rear portion of the drawer guide 700 due to the shield plate 711, even in the ejected state of the drawer 700.

Meanwhile, a hole (not shown) may be formed through the shield plate 711. A support bracket 713 may also be arranged around the hole, to support a connector 432. Through the hole and support bracket 713, the connector 432 can be connected to an inlet 430 of the pump 400. Thus, when the drawer 700 is in an inserted state, the connector 360 of the cartridge 300 is connected to the connector 432, so that water from the cartridge 300 can be supplied to the pump 400.

A procedure for supplying water to the steam generator 200 in accordance with the present invention will be described with reference to FIG. 3 again. When the drawer 700 is completely inserted along the drawer guide 710, the cartridge 300 mounted in the drawer 700 is connected to the pump 400. In this state, water from the cartridge 300 is supplied to the steam generator 20 in accordance with an operation of the pump 400. As the supplied water is heated in the steam generator 200, steam is generated. The generated steam is supplied to the drum 20 (FIG. 1) via the steam hose 230.

Meanwhile, in order to supply steam during operation of the laundry machine, water must be supplied to the steam generator 200, as described above. This is possible only when the connector 360 of the cartridge 300 is in a state of being connected to the pump 400. If no water is supplied from the cartridge 300 to the pump 400 due to an incorrect connection of the cartridge 300 to the pump 400, the pump 400 and the heater (not shown) of the steam generator 200 may operate in a water shortage state, so that the pump 400 and steam generator 200 may be damaged.

Furthermore, when the user ejects the drawer 700 during operation of the laundry machine, in particular, during a steam spraying operation, water is no longer supplied to the steam generator 200 via the pump 400, so that the pump 400 and steam generator 300 may be damaged. In addition, when the drawer 700 is ejected during operation of the laundry machine, as described above, steam generated from the steam generator 200 may flow backwardly. In this case, the steam may be introduced into the interior of the laundry machine outside the drum. As a result, various constituent elements of the laundry machine may be damaged by hot steam.

To this end, in accordance with the present invention, the sensor 800 is provided to sense whether or not the water supply device, namely, the cartridge 300 and drawer 700, is in a state of being correctly mounted in the cabinet 10, in an early operation stage of the laundry machine or during operation of the laundry machine. A detailed configuration of the sensor 800 is illustrated in FIG. 6.

Referring to FIG. 6, the sensor 800 may be arranged in the interior of the cabinet 10. Preferably, the sensor 800 is arranged at one side of the drawer guide 710.

In detail, the sensor 800 may be mounted to a front surface of the shield plate 711 of the drawer guide 710. In this case, the sensor 800 may be pressed by the rear end of the drawer 700 (FIG. 4) when the drawer 700 is inserted along the drawer guide 710. Alternatively, the sensor 800 may be pressed by a rear end surface 733 (FIG. 4) of the first guide 732 (FIG. 4) when the drawer 700 is inserted along the drawer guide 710. When the sensor 800 is pressed in the above-described manner, it may generate an electrical signal.

In accordance with the present invention, the sensor 800 may comprise a switch. Of course, the sensor 800 is not limited to such a switch. For example, a first connecting terminal may be mounted to the rear end of the drawer 700, and a second connecting terminal corresponding to the first connecting terminal may be mounted to the drawer guide 710, in order to generate a signal when the first and second connecting terminals are connected to each other. Thus, various configurations may be used for the sensor 800.

Meanwhile, the electrical signal generated from the sensor 800 is sent to a controller (not shown), which controls operations of various constituent elements of the laundry machine, for example, the steam generator 200, pump 400, and air heater 90.

The controller drives the steam generator 200 and pump 400 only when the electrical signal from the sensor 800 is sent to the controller. That is, the controller 800 checks whether or not there is an electrical signal sent from the sensor 800, before steam is supplied to the interior of the laundry machine in accordance with the operation of the laundry machine. When the controller receives the electrical signal from the sensor 800, it determines that water from the cartridge 300 is supplied to the pump 400 as the drawer 700 is correctly mounted. In this case, the controller drives the pump 400 and steam generator 200, for the generation of steam.

Meanwhile, when the controller cannot sense any electrical signal generated from the sensor 800 within a predetermined time, for example, about 1 minute, prior to the supply of steam to the interior of the laundry machine, the controller determines that the drawer 700 is in an incorrectly-mounted state. In this case, the controller may generate a warning message, in order to enable the user to recognize the incorrectly-mounted state of the drawer 700. For this function, although not shown, the laundry machine may include a display or a speaker. In accordance with the provision of the display or speaker, the controller can generate a visual or audible warning message.

The controller may also check whether or not the electrical signal is continuously generated as the drawer 700 is maintained in a correctly-mounted state, during operation of the laundry machine, namely, during an operation of the steam generator 200 to supply steam to the interior of the drum 20. When the user ejects the drawer 700 during operation of the laundry machine, no electrical signal is generated from the sensor 800. In this case, the controller determines that the drawer 700 is in a separated state. In accordance with this determination, the controller stops the operations of the pump 400 and steam generator 200, and generates a warning message, to inform the user of the separation of the drawer 700.

Figure 7:
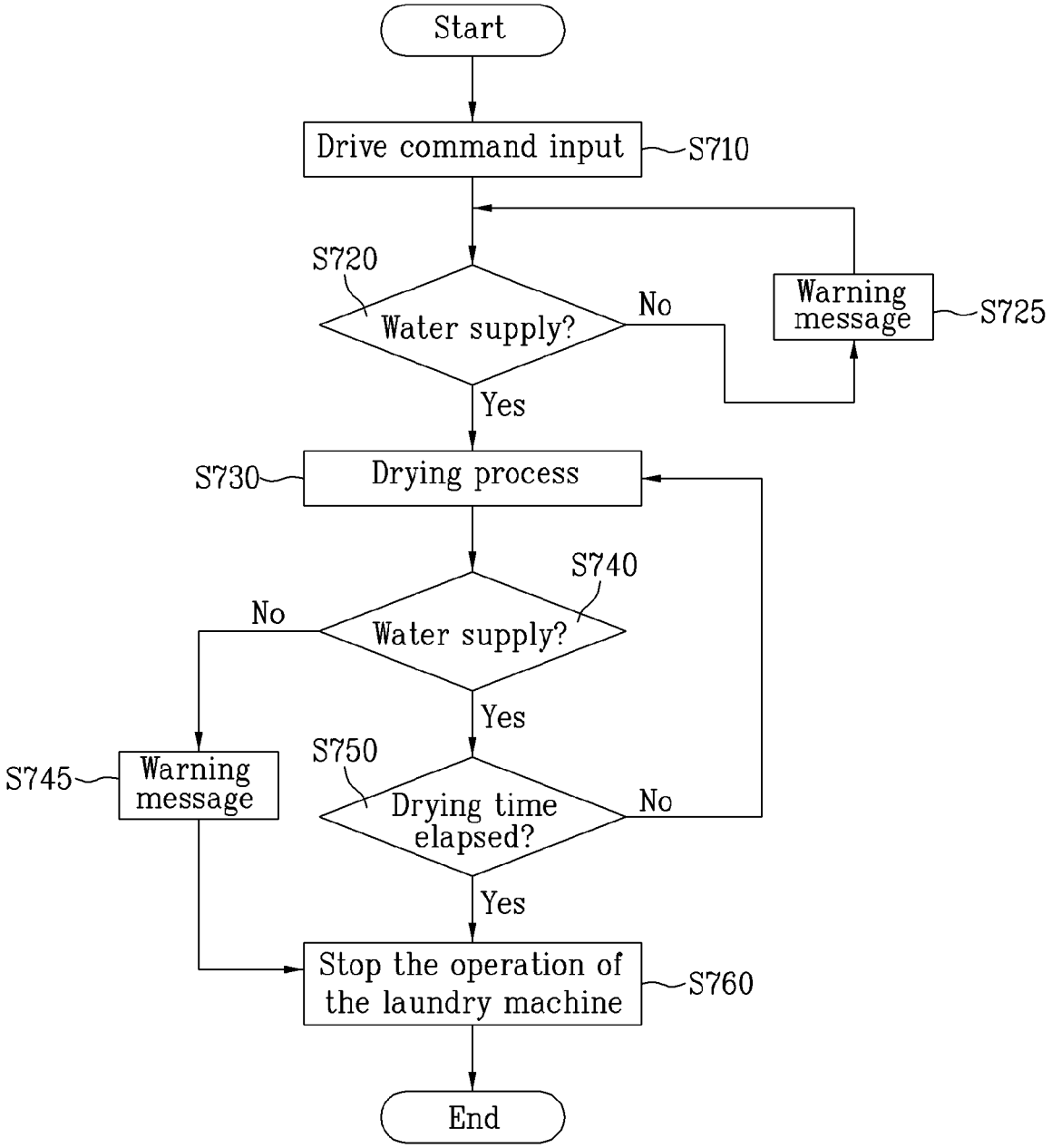
FIG. 7 is a flow chart illustrating a method for controlling a laundry machine in accordance with a preferred embodiment of the present invention.

Hereinafter, a method for controlling the laundry machine having the above-described configuration will be described. FIG. 7 is a flow chart illustrating a method for controlling the laundry machine in accordance with a preferred embodiment of the present invention.

Referring to FIG. 7, the laundry machine control method according to the illustrated embodiment of the present invention mainly includes a procedure S710 for receiving a driving command input for the laundry machine, a procedure S720 for sensing whether or not water is supplied to the steam generator of the laundry machine, and a procedure S730 for executing a drying process of the laundry machine.

First, the controller senses whether or not there is a driving command input from the user for the laundry machine (S710).

When the user inputs the driving command, the controller then senses whether or not water is supplied to the steam generator 200 (S720). In detail, the controller senses whether or not there is an electrical signal sent from the sensor 800. When an electrical signal is sent from the sensor 800, the controller determines that water is supplied to the steam generator 200 as the drawer 700 is in a correctly-mounted state. Thus, the controller drives the steam generator 200 and pump 400 only when the electrical signal is sent from the sensor 800, in order to execute a drying process.

On the other hand, when the controller cannot sense any electrical signal generated from the sensor 800 within a predetermined time, for example, about 1 minute, after the inputting of the driving command from the user, the controller determines that the drawer 700 is in an incorrectly-mounted state. In accordance with this determination, the controller generates a warning message (S725). The controller then continuously checks whether or not there is an electrical signal sent from the sensor 800, in order to drive the steam generator 200 and pump 400 only when the electrical signal is sent from the sensor 800, for the execution of the drying process.

When the electrical signal is sent from the sensor 800, the drying process is executed (S730). Meanwhile, during the execution of the drying operation, the controller periodically senses whether or not the electrical signal is continuously generated, in order to periodically sense whether or not water is continuously supplied (S740).

When the electrical signal is continuously generated, the controller determines that water is continuously supplied. In this case, the controller then determines whether or not a predetermined drying time has elapsed (S750). When the controller determines that the predetermined drying time has elapsed, it stops the operations of the steam generator 200, pump 400, and air heater 90 (S760).

On the other hand, when no electrical signal is sent from the sensor 800 during the operation of the laundry machine, the controller determines that no water is supplied due to an abnormal separation of the drawer 700. In this case, the controller generates a warning message (S745), and stops the operation of the laundry machine (S760).

As apparent from the above description, the laundry machine according to the present invention provides the following effects.

The laundry machine can effectively remove creases or rumples possibly formed on clothes without performing ironing because steam is sprayed onto the clothes in a completely-dried state of the clothes.

In accordance with the present invention, the laundry machine operates only when water is supplied to the steam generator, so that it is possible to prevent the laundry machine from being damaged or broken.

In accordance with the present invention, an abnormal ejection of the water supply source during operation of the laundry machine is sensed, to stop the operation of the laundry machine, and thus to prevent the laundry machine from being damaged or broken.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a laundry machine including a drum rotatably provided in a cabinet, a substance supply device supplying a water based substance to the drum, a water supply device detachably provided to the cabinet to be filled with water by a user to supply water to the substance supply device, a sensor provided to sense whether or not the water supply device is correctly mounted in the cabinet, and a controller to generate a warning message, comprising:

receiving a command input to operate the laundry machine;

determining whether or not water is supplied to the substance supply device of the laundry machine by the controller, wherein the water supply determining step includes sensing whether or not the water supply device is correctly mounted in the cabinet of the laundry machine by the sensor, and generating a warning message when the water supply device is not correctly mounted or is detached from the laundry machine; and executing a drying process of the laundry machine.

2. The method according to claim 1, wherein the water supply determining step further comprises:

sensing whether or not there is an electrical signal generated from the sensor of the laundry machine, which generates the electrical signal when the water supply device is correctly mounted in the cabinet.

3. The method according to claim 2, wherein the water supply determining step further comprises:

generating a warning message when there is no electrical signal generated from the sensor for a predetermined time.

4. The method according to claim 2, wherein the water supply determining step proceeds to the drying process executing step when the electrical signal is generated from the sensor.

5. The method according to claim 2, further comprising:

sensing whether or not there is an electrical signal generated from the sensor during the drying process executing step.

6. The method according to claim 5, further comprising:

generating a warning message when there is no electrical signal generated from the sensor during the drying process executing step.

7. The method according to claim 6, further comprising:

stopping the execution of the drying process when there is no electrical signal generated from the sensor during the drying process executing step.

8. The method according to claim 1, wherein the substance supply device comprises a pressure apply device applying a predetermined pressure to the water supplied to the drum.

9. The method according to claim 1, wherein the water supply device comprises:

a drawer detachably provided at one side of the cabinet; and a cartridge detachably mounted in the drawer, for containing water to be supplied to the substance supply device.

10. The method according to claim 9, wherein the water supply determining step comprises:

sensing whether or not the cartridge and the drawer is in a stage of being correctly mounted in the cabinet.

11. The method according to claim 10, the laundry machine further comprises a pump connected between the water supply device and the substance supply device.

12. The method according to claim 11, further comprising driving the substance supply device and the pump when the cartridge and the drawer is correctly mounted in the cabinet.

13. The method according to claim 11, further comprising stopping an operation of the substance supply device and the pump when the cartridge and the drawer is incorrectly mounted in the cabinet during the drying process executing step.

* * * * *